United States Patent [19]

Van Cleave

[11] 4,389,869

[45] Jun. 28, 1983

[54] SHEET METAL BENDING BRAKE

[75] Inventor: Eugene H. Van Cleave, Orchard Lake, Mich.

[73] Assignee: Van Mark Products Corporation, Farmington Hills, Mich.

[21] Appl. No.: 207,944

[22] Filed: Nov. 18, 1980

[51] Int. Cl.³ ..... B21D 5/04

[52] U.S. Cl. ..... 72/319; 72/461; 269/304

[58] Field of Search ..... 72/319–323, 72/293, 295, 316, 461, 36; 269/249, 303, 304

[56] References Cited

U.S. PATENT DOCUMENTS

| | | | |
|---|---|---|---|
| 1,128,421 | 2/1915 | Diamond | 72/319 |
| 2,422,042 | 6/1947 | Roberts | 72/35 |
| 2,478,854 | 8/1949 | Webb | 72/319 |
| 2,565,965 | 8/1951 | Hartmann | 269/249 |
| 3,020,590 | 2/1962 | Siegert | 72/322 |
| 3,260,087 | 7/1966 | Guarino | 72/36 |
| 3,983,735 | 10/1976 | Berry | 72/319 |
| 4,237,716 | 12/1980 | Onisko | 72/319 |

FOREIGN PATENT DOCUMENTS

| | | | |
|---|---|---|---|
| 66965 | 11/1914 | Austria | 269/249 |
| 8986 | 3/1880 | Fed. Rep. of Germany | 269/249 |
| 44090 | 8/1888 | Fed. Rep. of Germany | 72/320 |
| 85047 | 10/1971 | German Democratic Rep. | 72/319 |
| 3345 | 1/1891 | Switzerland | 72/320 |

*Primary Examiner*—Daniel C. Crane
*Attorney, Agent, or Firm*—Hiram P. Settle

[57] ABSTRACT

A sheet material bending brake of enhanced clamping and bending capacity, by virtue of reinforcing members which both limit the extent of insertion of sheet material into the brake and which support the brake against distortion under heavy clamping and bending loads. The brake includes a plurality of parallel "C" castings extending normally to a bending plane, the castings having clamping and bending means located at their cantilevered ends. Adjustable reinforcing elements engage horizontal surfaces of the castings and project across the throats of the castings to retain the casting legs against separation under excess clamping and bending loads imposed thereon and to limit the distance to which the sheet material can be inserted into the castings.

17 Claims, 10 Drawing Figures

SHEET METAL BENDING BRAKE

BACKGROUND OF THE INVENTION

In the operation of brakes for bending sheet metal, such as those disclosed in U.S. Pat. Nos. 3,147,791 to Rauen et al and 3,877,279 to the present applicant, the metal to be bent is clamped at the location of the desired bend between a pair of clamping members carried at the remote ends of "C"-shaped castings. The clamping load and the bending load are both imposed on the "C"-shaped castings which must be of appreciable depth, on the order of twelve inches or more, so that the sheet metal can extend into the "throat" of the castings.

The arms of the castings and the clamping and bending means carried thereby are, in effect, cantilevered from the curved joining portions of the individual castings. As a result, excessive bending loads, as where heavy gauge sheet metal is being bent, tend to spread the clamping members by deflecting and permanently distorting the arms of the castings. Thus, severe limitations are placed on the use of conventional lightweight, portable bending brakes, and the user must be careful not to bend sheet metal of excessive thickness, lest he distort his brake sufficiently to render it incapable of subsequently clamping any sheet metal into position for bending.

Also, prior art brakes have utilized stops which are adjustable along the throat of the castings, so that the stops, when adjusted, limit the extent of insertion of the sheet metal into the throat. Typically, two such stops are provided at the extremities of the brake, and the stops are adjusted to the desired distance from the bending plane. Upon clamping of the sheet metal into position, the abutment of the sheet metal with the stops assures the bending of the sheet metal at the desired location.

BRIEF DESCRIPTION OF THE PRESENT INVENTION

In the sheet metal bending brake of the present invention, a plurality of "C" castings are secured together on base rails or the like in parallel array, so that each casting extends perpendicularly to the plane of bending of the sheet material. The castings each comprise a pair of vertically spaced legs defining a "throat" therebetween, and the cantilevered legs are provided at their free extremities with cooperating clamping means for securing sheet material in position to project into the casting throats. That portion of the sheet material which projects beyond the castings is engaged by a bending leaf which, in effect, is carried by one of the casting arms. In the normal use of the bending brake, an attempt to bend excessively thick sheet material will impose an upwardly acting load on the upper arms of the castings and will distort the casting arms upwardly. If this occurs, the castings may be deflected beyond their elastic limit and permanently distorted, so that the brake is incapable of securely clamping any sheet material in subsequent bending operations.

The present invention proposes a reinforcing element which supports the arms of the castings against deflection where it is necessary to bend sheet metal of excessive thickness or where the bending loads imposed on the sheet material are sufficient to deflect the casting arms. In essence, the present invention comprises an adjustable "C"-shaped clamp which engages each arm of the casting and which is adjustable along the casting arms to provide varying degrees of reinforcement. The castings are normally formed as "I"-beam sections, and the castings of the present invention, in contrast to the prior art, have parallel "I"-beam flanges on either side of the casting throat. The reinforcing member includes a pair of spaced, horizontal marginal portions parallel to the beam flanges and engageable therewith, and a vertical joining portion which bridges the casting throat and rigidly joins the end portions. Any attempted deflection of the casting arms will be resisted by the reinforcing means, and the degree of reinforcement can be varied by adjusting the reinforcing means toward and away from the clamping and bending elements carried by the castings.

Various forms of reinforcing means are provided by the present invention, but they all, in effect, extend across the throat of the casting into an engagement with the casting flanges to prevent separation of the flanges and to prevent distortion of the castings. Since the reinforcing members also extend across the throat of the casting, they limit the degree to which the sheet material can be inserted into the casting throat. Thus, the reinforcing members also serve as adjustable stops. For example, where it is desired to bend a piece of sheet material at a location six inches from one edge, the reinforcing members may be adjusted so that they are positioned six inches from the bending plane, the sheet material is inserted into the casting throats into abutment with the stops after they have so positioned, and the bend is made.

Various forms of reinforcing members are provided by the present invention, and these various forms utilize different types of means for retaining the reinforcing members in position. The retention means, for example, may be a simple set screw or a spring biased locking pawl engageable with teeth formed on the casting. Preferably, a separate reinforcing means is provided for each of the castings, although less than all of the castings may be reinforced where the material to be bent is of intermediate thickness. A pair of reinforcing members may be provided for each casting, if increased reinforcement is desired. Of course, it is not necessary to adjust all of the reinforcing means to serve as stops where this is the only function to be performed.

PREFERRED EMBODIMENTS OF THE PRESENT INVENTION

Figure 1:
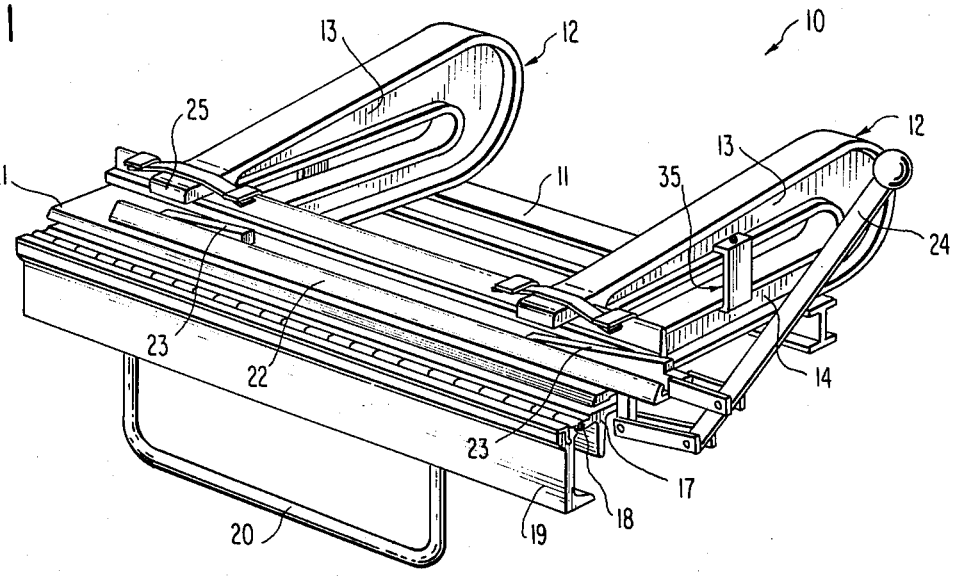
FIG. 1 is a elevational perspective view showing a sheet material bending brake incorporating the present invention.

As shown on FIG. 1 of the drawings, reference numeral 10 refers generally to a brake of the present invention comprising a pair of support rails 11 supporting thereon a plurality of "C" castings 12.

Figure 2:
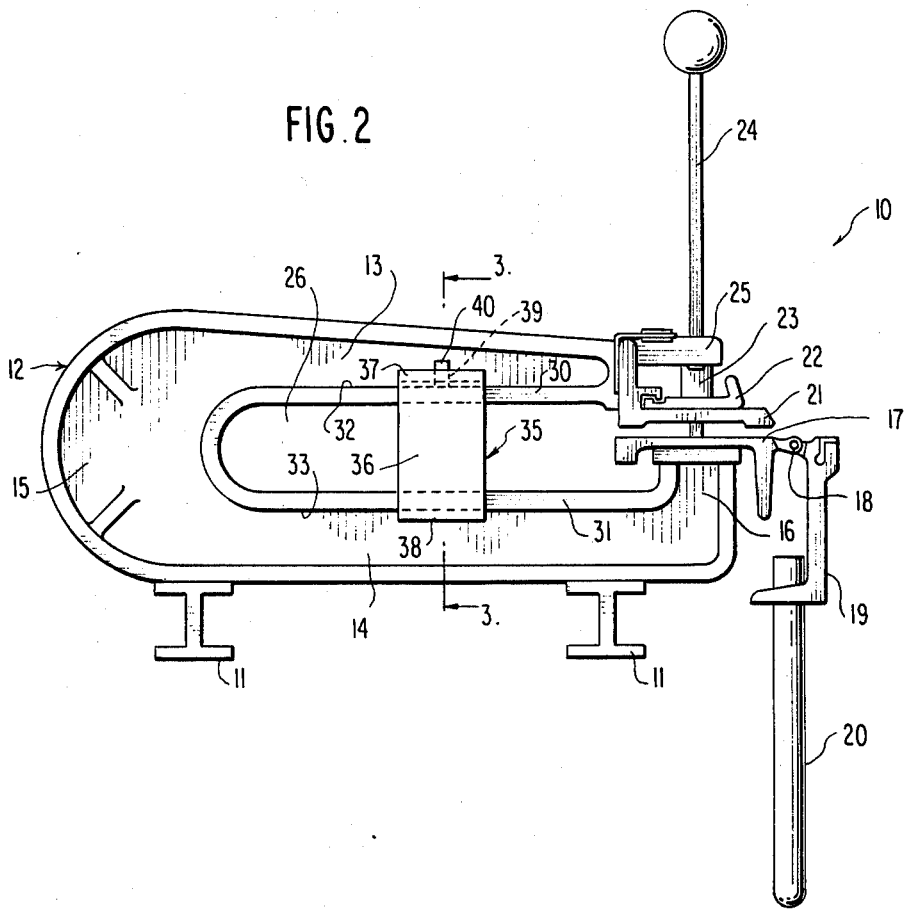
FIG. 2 is an enlarged elevational end view of the brake of FIG. 1.

The castings 12, as illustrated in detail in FIG. 2 comprise an upper leg 13 and lower leg 14 which are cantilevered from a rear joining portion 15. The castings 12 preferably are cast from aluminum or the like light weight metal, and each arm 13, 14 has the configuration of an "I"-beam, as best shown in FIG. 3.

The cantilevered forward end 16 of the lower arm has superimposed thereon a continuous clamping extrusion 17 which is hingedly connected, as at 18, to a bending leaf 19 provided with an elongated handle 20. The upper cantilevered arm is provided at its forward extremity with a clamping extrusion 21 having superimposed thereon a locking bar 22 provided with actuating cams 23 actuated by a handle 24 for sliding movement beneath fixed retainers 25 to clamp a piece of sheet metal between the members 17, 21. The sheet metal clamped between the members 17, 21 extends into the casting throats 26 which are defined between the cantilevered arms 13, 14. Once the sheet metal is clamped into position, the operator grasps the handle 20 and elevates it, so that the bleeding leaf 19 contacts the undersurface of the clamped sheet metal and bends it upwardly about the clamping extrusion 21.

In accordance with the present invention, each of the castings 21 has its throat 26 defined between parallel flanges 30, 31 of the arms 13, 14. More specifically, as shown in FIG. 3 of the drawings, the upper surface 32 of the lower flange 30 of the upper arm 13 is parallel to the lower surface 33 of the upper flange 31 of the lower arm 14. These parallel surfaces 32, 33 are those utilized for the reinforcing means of the present invention.

Figure 3:
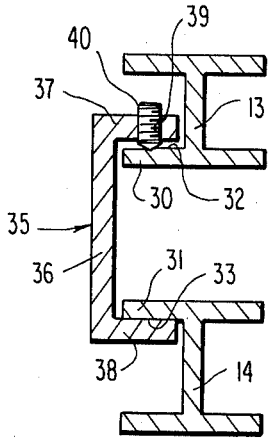
FIG. 3 is a sectional view taken along the plane 3—3.

Also, as best shown in FIGS. 2 and 3, a reinforcing means 35 is movable along the surfaces 32, 33. This reinforcing means 35 is a generally "C"-shaped element having a vertical joining portion 36 terminating in inturned flanges 37, 38. The flanges 37, 38 are of a lateral extent such that they project inwardly to overlie the surfaces 32, 33 but without striking the webs of the arms 13, 14. The vertical spacing of the arms 37, 38 is slightly greater than the spacing between the surfaces 32, 33, and the upper arm 37 is provided with a threaded aperture 39 for receiving a set screw 40 therethrough.

In operation, the reinforcing means 35 prevents spreading of the arms 13, 14 of the castings 12, by virtue of joining the flanges 30, 31 at a location intermediate the clamping members 17, 21 and the joining portion 15 of the casting 12. In effect, the joining member 35 reduces the cantilevered length of the arms 13, 14, and the reinforcing member 35 prevents spreading of the arms 13, 14 under excessive bending loads imposed on the ends of the arms when excessively thick sheet material is bent by elevating the bending leaf 19. Further, the reinforcing members 35 serve as stops for the sheet material being bent, since the sheet material inserted into the throats 26 will abut the reinforcing members 35 bridging the casting throats 26.

Preferably, the reinforcing member 35 is provided for each individual casting 12, although a lesser number of reinforcing members 35 may be utilized if desired. The adjustability of each of the reinforcing along the surfaces 32, 33 is accommodated by loosening of the set screws 40 by an appropriate socket wrench and simply sliding the reinforcing means to its desired location and then re-tightening the set screw. The extent of reinforcement depends upon the extent of reduction of the cantilevered length of the arms 13, 14, so that greater degrees of reinforcement are obtained as the reinforcing means 35 is moved along the surfaces 32, 33 toward the clamping elements 17, 21. Because of the stop functions of the reinforcing means 35, thicker or more difficulty bendable sheet material will necessarily be bent with a shorter length of the material projecting into the throat 26 of each casting 12.

Figure 4:
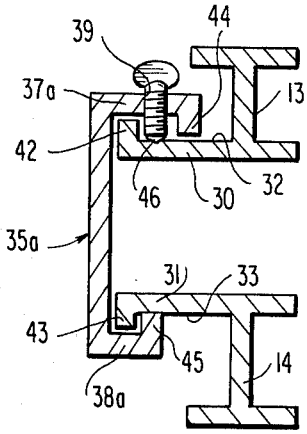
FIG. 4 is a sectional view similar to FIG. 3 illustrating a modified form of reinforcing member of the present invention.

In the modified version of the present invention in FIG. 4 of the drawings, a different form of reinforcing member 35*a* is provided, and each of the "I"-beam flanges 30, 31 is laterally elongated to be provided with vertical marginal flanges 42, 43, respectively. Similarly, the reinforcing member flanges 37*a*, 38*a* are provided with complimentary vertical flanges 44, 45. Also, a set screw 46 of the "thumb" type is provided on the upper reinforcing member flange 37 for engagement with the surface 32 of the arm 13. In this version of the invention, the flanges 42, 43 of the casting, and the flanges 44, 45 of the reinforcing member 35*a* aid in retaining the reinforcing member against accidental lateral displacement. A reinforcing member is easily assembled on the casting despite the flanges by simply inserting the reinforcing element 35*a* from the rear onto the casting flanges 30, 31.

Figure 5:
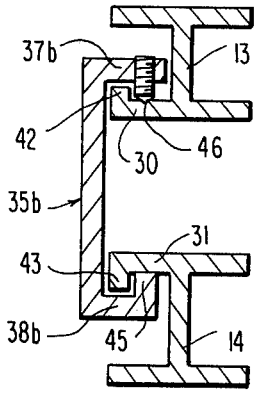
FIG. 5 is a view similar to FIG. 3 showing a different modified form of the present invention.

In that version of the invention shown in FIG. 5 of the drawings, the casting flanges 30, 31 are not extended (as in FIG. 4), but are provided with the terminal flanges 42, 43. Only the lower arm 38*b* of the reinforcing member 35*b* is provided with a flange 45. The protrusion of the set screw 46 beyond the lower extremity of the upper arm 37*b* of the reinforcing member 35*b* prevents lateral displacement of the reinforcing member 35*b* from the casting 12.

Figure 6:
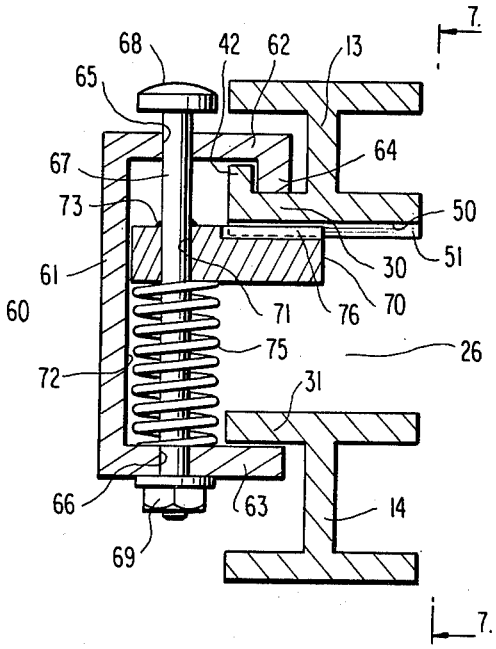
FIG. 6 is a sectional view similar to FIG. 3 showing a different form of adjustable reinforcing member.
Figure 7:
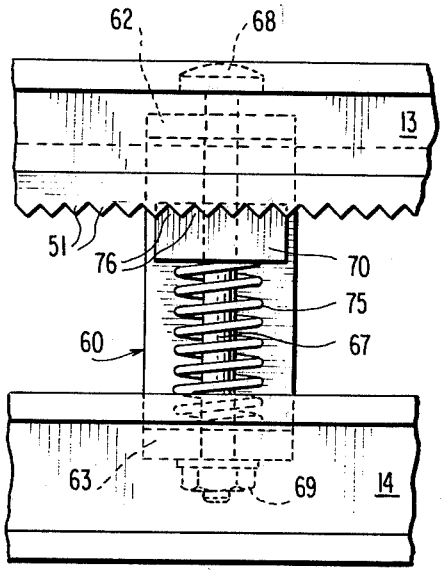
FIG. 7 is an enlarged sectional view taken along the plane 7—7 of FIG. 6.

Turning now to that embodiment of the invention shown in FIGS. 6 and 7, it will be noted that here the undersurface 50 of the upper arm 13 of the casting is provided with a plurality of transversely extending, longitudinally spaced serrations or teeth 51, and the upper surface of the flange 30 is provided with an upstanding flange 42, as earlier described.

The reinforcing member, in this version of the invention, is indicated by reference numeral 60 and includes a central joining portion 61 provided with terminal arms 62, 63 projecting inwardly into proximity to the casting flanges 30, 31. The upper arm 62 is provided with a terminal upstanding flange 64. The upper and lower arms 62, 63 have aligned apertures 65, 66 therein to receive a vertical push rod 67 provided with an enlarged upper head 68 and with a threaded lower end receiving a nut 69.

Slidably positioned on the push rod 67 is a locking pawl 70 which is rectangular in configuration. The locking pawl 70 is apertured, as at 71, to receive the push rod 67 therethrough and is guided for sliding movement by its contact with the inner surface 72 of the joining portion 61 of the reinforcing member 60. The locking pawl preferably is fixed to the push rod 67 by suitable means, as by welding or brazing at 73.

As best shown in FIGS. 6 and 7, the locking pawl projects into the throat 26 of the casting and the pawl is urged upwardly into contact with the teeth 51 by a compression spring 75 confined between the pawl and the lower arm 63 of the reinforcing member 60. Preferably, the upper surface of the pawl 70 is provided with teeth 76 which mesh with the flange teeth 51 to secure the locking member in position along the flange 30 of the arm 13.

In operation, the push rod 68 is depressed to move the locking pawl downwardly, and the reinforcing member is then inserted from the rear onto the flanges 30, 31 with the flanges 42, 64 retaining the reinforcing member in interlocked relation with the casting. The reinforcing member then is positioned at its desired location along the length of the casting 12, and the push rod is manually released to allow the spring 75 to urge the locking pawl 70 upwardly, so that the teeth 76 on the pawl engage the teeth 51 on the undersurface of the flange 30. During use, the reinforcing member 60 can be adjusted at any time by simply pressing the push rod 68 to space the locking pawl teeth 76 from the flange teeth 51, moving the reinforcing member to its desired location, and then manually releasing the push rod 68 so that the spring 75 urges the pawl upwardly into locking engagement with the arm 13.

Figure 8:
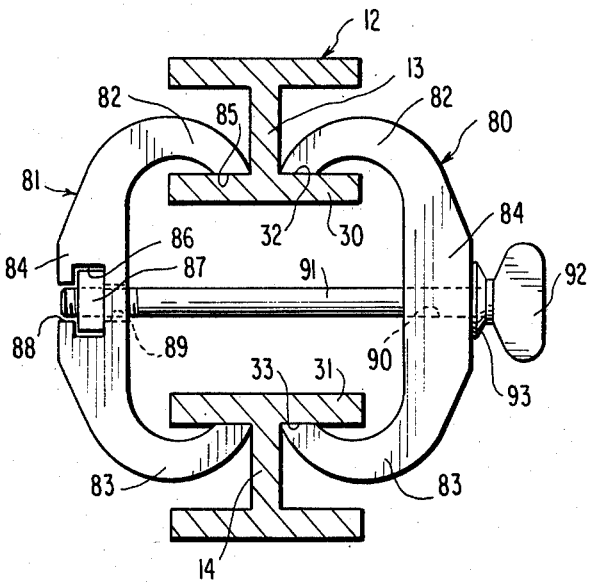
FIG. 8 is a view similar to FIG. 3 showing another modified form of the invention.
Figure 9:
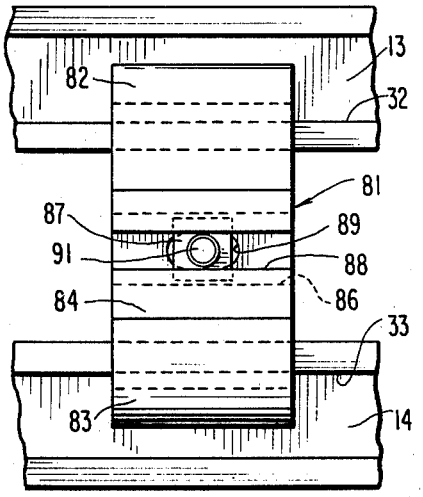
FIG. 9 is an elevational view of the modification of FIG. 8.

In that version of the invention illustrated in FIGS. 8 and 9, a pair of reinforcing members 80 and 81 are utilized in connection with each casting 12. The reinforcing members 80, 81 are "C"-shaped in contour, each having upper and lower arcuate end portions 82, 83 joined by a medial joining portion 84, the end portions 82, 83 each terminating in a planar abutment surface 85 which contacts the adjacent parallel surface 32, 33.

The member 81 has located in its medial portion 84 a reentrant groove 86 receiving therein a rectangular nut 87 of such size that the nut cannot turn or rotate in the groove. The groove 86 communicates through the passage 88 with the exterior and with the casting throat through a laterally elongated slot 89.

The medial portion 84 of the other clamping member 80 is provided with a horizontal passage 90 through which a bolt 91 freely passes for threaded engagement with the nut 87 entrapped in the groove 86 by the reinforcing member 81. The bolt 91 is freely rotatable in the aperture 90 and carries at its free outer end an enlarged head by which the bolt 91 can be rotated. Preferably, an enlarged washer 93 is interposed between the head 92 and the member 84 to provide an enlarged contact area therebetween.

In use, the elements 80, 81 are positioned on opposite sides of the casting 12 with their respective surfaces 85 closely spaced from the adjacent parallel surfaces 32, 33 of the casting 12, the bolt 91 is inserted through the aperture 90 in the member 80 and is threaded into the nut 87. Upon tightening of the bolt 91, the members 80, 81 are drawn toward one another until such time as their free ends 82 abut the webs of the casting arms 13, 14. The elongated or ovalized aperture 89 in the member 81 simply facilitates the insertion of the bolt 91 into the nut 87. Preferably, the members 80, 81 are formed by extrusion of a continuous length and then simply cutting the extrusion to the desired lateral extent to form the members 80, 81. The only post extrusion work which is required is the cutting or punching of the apertures 89, 90 in the members 81, 80, respectively.

Figure 10:
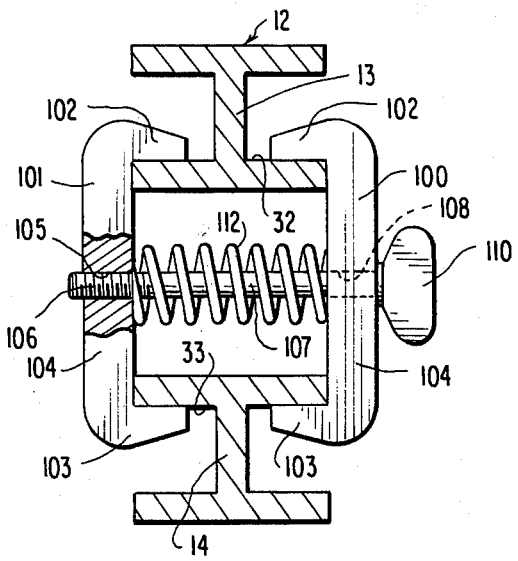
FIG. 10 is a view similar to FIG. 8 of further modification.

In that version of the invention illustrated in FIG. 10, the reinforcing members 100, 101 are more angular in configuration having inturned terminal portions 102, 103 joined by medial portions 104. The element 101 has a threaded aperture 105 receiving the threaded end 106 of a bolt 107 projecting through an aperture 108 formed in the member 100 and having an enlarged actuating head 110. A compression spring 112 is interposed between the members 100, 101 to bear upon the inner surfaces of the medial portions 104 thereof.

As shown, the spacing between the respective ends 101, 103 of the members 100, 101 is slightly greater than the spacing between the parallel surfaces 32, 33 so that the reinforcing members prevent separation of the arms 13, 14 of the casting 12. To adjust the members longitudinally to a desired position, the bolt 110 is loosened so that the spring 112 forces the members 100, 101 to separate, the members are simply adjusted along the length of the surfaces 32, 33, and the bolt is retightened.

It will be appreciated that those embodiments of FIGS. 8 through 10 are utilized in pairs, preferably one pair per "C" casting 12, to provide enhanced resistance to separation of the arms 13, 14 of the casting 12. It will be understood that the surfaces 85 of the members 80, 81 and the undersurfaces of the terminal portions 102, 103 of the members 100, 101 are spaced apart a distance slightly greater than the space between the surfaces 32, 33, so that the respective clamping elements can be inserted over the surfaces 32, 33 and moved there along for adjustment.

The illustrated embodiments of the invention are only representative of the principles of the invention, and the physical form of the brake may be varied substantially without departing from these principles. In particular, many different forms of reinforcing members may be utilized, so long as such members, in effect, reduce the cantilevered length of the casting arms.

I claim:

1. In a sheet metal bending brake having a plurality of "C" castings secured in spaced aligned positions so that each casting lies normal to a desired bending plane, sheet metal clamping means located at the cantilevered free ends of the casting to secure a sheet in bending position with a portion of the sheet extending from the bending plane into the throats of the "C" castings, and a movable bending leaf carried by the castings adjacent the clamping means for bending the sheet along the bending plane, the improvements of parallel surfaces on those portions of said castings adjacent the throats, a pair of reinforcing members each having end portions engaging the parallel surfaces of each of the castings and each having vertical joining portions integral with said end portions and projecting across the throats of the castings, respectively, and means joining together each pair of reinforcing members, said joining means releasably clamping said reinforcing members onto the interposed casting in fixed positions along the length of the parallel throat surfaces (1) to limit the extent of insertion of the sheet into the throats of the castings and (2) to prevent spreading of the cantilevered free ends of the casting during clamping and bending of said sheet.

2. A sheet material bending brake comprising a plurality of "C"-shaped castings, means retaining said castings in parallel array so that each casting is perpendicular to a bending plane, clamping and bending means located at the free cantilevered ends of said castings to retain a sheet of material in bending position with a portion of the sheet projecting into the throat of the castings so that the remainder of the sheet can be bent along said plane, each casting having a pair of horizontal surfaces adjacent its throat on either side thereof, individual rigid substantially "C"-shaped clamps slidably engaging said surfaces and spanning the throat of each casting to resist spread of the castings under the clamping and bending loads imposed thereon, said "C"- shaped clamp being slidably movable toward and away from said clamping and bending means, and means carried by each clamp and engagable with the associated casting to retain said clamp in slidably adjusted position thereon.

3. In a sheet metal bending brake having a plurality of "C" castings secured in spaced aligned positions to lie normal to a desired bending plane, and sheet metal clamping and bending means located at the centilevered free ends of the casting to clamp a sheet in bending position with a portion of the sheet extending from the bending plane into the throats of the "C" castings and to bend the sheet along the bending plane, the improvements of means for simultaneously (1) adjusting the resistance of said "C" castings to spreading under the clamping and bending loads imposed thereon during operation of the brake and (2) adjustably limiting the extent of insertion of sheet metal into the throats of said castings, said means comprising oppositely directed parallel, horizontal surfaces on those portions of at least some of said castings adjacent the throats, and a plurality of "C"-shaped reinforcing means slidable along said horizontal surfaces of at least some of the castings, said "C"-shaped reinforcing means each comprising horizontal end portions conforming to and engaging said oppositely directed surfaces of at least some of the castings, vertical joining portions integral with said end portions to project across the throats of the castings, and clamping means for securing at least one horizontal end portion in adjusted position along the adjacent horizontal surface.

4. In a brake as defined in claim 3, the improvement of a flange at the end of each parallel surface of each casting, the flange being directed away from said throat, and a mating flange on at least one horizontal surface of said reinforcing member, and a set screw located on said reinforcing member for engagement with said casting surface.

5. In a brake as defined in claim 3, the improvement of a clamping element carried by the medial portion of the reinforcing member for vertical movement relative thereto into and out of clamping engagement with the associated "C" casting, and means biasing said clamping element towards said casting.

6. In a brake as defined in claim 3, the improvement of a clamping element carried by the medial portion of the reinforcing member for vertical movement relative thereto into and out of clamping engagement with the associated "C" casting, means biasing said clamping element toward said casting, and a push rod projecting through one of the end portions of said joining member for manually disengaging said clamping element from said "C" casting against the bias of said biasing means.

7. In a brake as defined in claim 3, the improvement of an upturned flange at the end of each parallel surface of said casting, said flanges being directed away from said throat, a mating flange on one horizontal surface of said reinforcing member, and a set screw located on the other horizontal surface of said reinforcing member for engagement with said casting surface inwardly of the associated casting flange.

8. In a brake as defined in claim 3, the further improvement of a vertical flange on each of the horizontal surfaces of each casting, each flange being directed away from said throat, and a set screw carried by each clamp for engagement with one of the horizontal casting surfaces inwardly of said flange.

9. In a brake as defined in claim 3, the further improvement of a clamping element carried by the joining portion of said reinforcing means for movement relative thereto into and out of clamping engagement with the associated "C" casting, and spring means urging said clamping element into such clamping engagement.

10. In a brake as defined in claim 3, the improvement of clamping pawls carried by the joining portion of the reinforcing members, respectively, for clamping engagement with the associated "C" casting, means biasing said clamping pawls toward such engagement, and a push rod projecting through one of the end portions of said members for manually disengaging said clamping pawls from said "C" castings against the bias of said biasing means.

11. In a brake as defined in claim 3, the improvement of a vertical flange at the end of each said surface of said casting, said flanges being directed away from said throat, a mating flange on at least one of said end portions, and a set screw located on one end portion of said reinforcing means for engagement with said casting inwardly of the associated casting flange.

12. A sheet material bending brake as defined in claim 3, wherein a pair of individual "C"-shaped reinforcing means engage each arm of at least some of said castings, and the means securing each such pair of reinforcing means to the associated casting includes a fastener engaging the reinforcing means to each pair and projecting across the throat of the associated casting.

13. In a sheet material bending brake comprising a plurality of "C"-shaped castings having vertically spaced arms cantilevered from a joining portion to define a throat therebetween, means retaining said castings in parallel array so that each casting is perpendicular to a bending plane, clamping and bending means located at the free ends of the arms of said castings to retain a sheet of material in bending position with a portion of the sheet projecting into the throat of the castings so that the remainder of the sheet can be bent along said plane, the improvements of means for simultaneously (1) adjusting the resistance of said "C" castings to spreading under the clamping and bending loads imposed thereon during operation of the brake and (2) adjustably limiting the extent of insertion of sheet metal into the throats of said castings, said means comprising "C"-shaped clamps having end portions slidably engaging each arm of at least some of said castings, respectively, and bight portions spanning the throat of each such casting, and manually actuated retaining means securing each such clamp to the associated casting to retain said clamp in slidably adjusted position thereon.

14. In a sheet metal bending brake wherein a plurality of "C"-shaped castings are retained in parallel array so that each casting is perpendicular to a bending plane, and clamping and bending means are located at the free cantilevered ends of said castings to retain a sheet of material is bending position with a portion of the sheet projecting into the throat of the castings so that the remainder of the sheet can be bent along said plane, the improvement increasing the distortion resistance of the cantilevered ends of the castings, said improvement comprising oppositely laterally directed horizontal surfaces on each casting adjacent the throat thereof, a pair of individual "C"-shaped clamps each in engagement with vertically spaced pairs of said surfaces and extending across the casting throat, and fastening means joining said clamps of each pair to one another, said fastening means retaining said clamps in contact with the casting interposed therebetween to resist spreading of the cantilevered castings under the clamping and bending loads imposed thereon.

15. In a sheet metal bending brake having a plurality of "C"-shaped castings provided with sheet metal clamping and bending means at the spaced, cantilevered ends thereof, the improvement of means for preventing the spreading and distortion of said castings under excessive clamping and bending loads imposed at the free cantilevered ends of said legs, comprising a pair of reinforcing members disposed on either side of at least some of said castings, each reinforcing member engaging the casting adjacent the throat thereof at locations above and below said throat with a medial portion of the reinforcing member extending across the plane of the throat exteriorly thereof, means joining the reinforcing members of each pair to urge the reinforcing members into contact with the associated casting, and means accommodating relative separation of said reinforcing members to permit their adjustment along the throat of said casting.

16. In a brake as defined in claim 13, the further improvement wherein each reinforcing member is of "C"-shape having confronting horizontal faces engageable with mating faces formed on the associated casting on either side of the casting throat, each reinforcing member has a vertical portion abuttable with a vertical portion of the associated casting, and the joining means extends laterally from one member of each pair to the other member of that pair to urge the reinforcing members against the adjacent vertical portion of the associated casting.

17. In a brake as defined in claim 12, the further improvement wherein the joining means comprises a nut carried by one of the reinforcing means to each pair and a tension bolt carried by the other of the members and threaded into said nut to traverse the throat of the associated casting.

* * * * *